US005668337A

United States Patent [19]

Kondo et al.

[11] Patent Number: 5,668,337

[45] Date of Patent: Sep. 16, 1997

[54] AUTOMATIC PERFORMANCE DEVICE HAVING A NOTE CONVERSION FUNCTION

[75] Inventors: Masao Kondo; Shinichi Ito; Hiroki Nakazono, all of Hamamatsu, Japan

[73] Assignee: Yamaha Corporation, Japan

[21] Appl. No.: 583,450

[22] Filed: Jan. 5, 1996

[30] Foreign Application Priority Data

Jan. 9, 1995 [JP] Japan ..... 7-016349

[51] Int. Cl.[6] ..... G10H 1/00; G10H 1/36; G10H 1/38

[52] U.S. Cl. ..... 84/609; 84/613; 84/634

[58] Field of Search ..... 84/604–606, 609–611, 84/613–618, 612, 634–638

[56] References Cited

U.S. PATENT DOCUMENTS 5,220,122 6/1993 Shibukawa ..... 84/669

5,410,098 4/1995 Ito ..... 84/613

*Primary Examiner*—Jonathan Wysocki

*Assistant Examiner*—Marlon Fletcher

*Attorney, Agent, or Firm*—Graham & James LLP

[57] ABSTRACT

In a memory, there are stored a plurality of first automatic performance data and a plurality of second automatic performance data. Also, first note-conversion-related information is stored separately in corresponding relations to the individual first automatic performance data. Second note-conversion-related information is stored as information common to the second automatic performance data. In executing an automatic performance, the first and second automatic performance data are read out in accordance with the sequence of the performance so as to reproduce sounds based on note data contained in the read-out automatic performance data. During that time, notes of the first automatic performance data are converted in accordance with the first note-conversion-related information read out in correspondence with the first automatic performance data, while notes of the second automatic performance data are converted in accordance with the common second note-conversion-related information. Where automatic performance sounds are generatable in a plurality of channels, the note conversion process may be executed by processing automatic performance data to be generated in some of the channels as the first automatic performance data and automatic performance data to be generated in the other channels as the second automatic performance data.

18 Claims, 6 Drawing Sheets

DEFAULT CTAB

| CH | 1 | 2 | 3 | 4 | 5 | 6 | ····· |
|---|---|---|---|---|---|---|---|
| INSTRUMENT NAME | — | — | — | — | — | — | ····· |
| PART NO. | 1 (RHYTHM1) | 2 (RHYTHM2) | 3 (BASS) | 4 (CHORD1) | 5 (CHORD2) | — — | ····· ····· |
| PEB | 0 | 0 | 0 | 0 | 0 | — | ····· |
| SOURCE ROOT | C | C | C | C | C | — | ····· |
| SOURCE TYPE | M7 | M7 | M7 | M7 | M7 | — | ····· |
| NOTE CONVERSION TABLE DESIGNATION | NO CONVER. | NO CONVER. | BASS-PART TABLE | CHORD-PART TABLE | CHORD-PART TABLE | — | ····· |
| : | : | : | : | : | : | : | ····· |

AUTOMATIC PERFORMANCE DEVICE HAVING A NOTE CONVERSION FUNCTION

BACKGROUND OF THE INVENTION

The present invention relates generally to automatic performance devices such as sequencers having an automatic accompaniment function, and more particularly to automatic performance devices which have a function to execute note conversion based on a designated chord during an automatic performance.

Of automatic performance devices having been hitherto proposed, there is known a type which, for any of rhythm, bass and chord parts, executes an automatic performance on the basis of accompaniment pattern data stored separately from sequential performance data. In some automatic performance devices of this type, pattern numbers designating accompaniment pattern data to be used for automatic accompaniment are preset in the header of sequential performance data or by operating predetermined setting switches. Other automatic performance devices of the type contain sequential accompaniment data storing such pattern-data-designating pattern numbers in accordance with the progression of each music piece. Typically, for the bass and chord parts, such automatic performance devices are designed to conduct a note conversion process to convert the original notes on the basis of a designated chord into other notes suitable for the designated chord. The chord is designated manually by a user or operating person (operator) or by chord progression data separately stored in accordance with the progression of a music piece.

For example, U.S. Pat. No. 5,220,122 discloses that accompaniment patterns are prestored in a buffer and notes in any of the stored accompaniment patterns are converted in accordance with a note conversion table corresponding to a performed chord. This U.S. Patent fails to show that a common note conversion table is used for all the accompaniment patterns.

In the above-mentioned known automatic performance devices with such a note-converting function, however, it is preferable that a different note conversion process is carried out for each of the performance styles (e.g., rhythm styles such as pops, rock-and-roll, jazz and waltz), sections (e.g., main, fill-in, intro and ending) and parts. For example, it is preferable to apply a different pitch-limiting range of converted notes or a different note conversion table for each of the performance styles, sections and parts. In a simple form, note conversion will be executed on the basis of note-conversion-related information that is stored, along with the automatic accompaniment data, for each of the performance styles, sections and parts. Such a simple approach is however disadvantageous in that it requires a large memory capacity for storing the note-conversion-related information because such information has to be stored for each performance section and part of every performance style even where the information partly overlaps and hence can be shared among the performance styles, sections or parts.

SUMMARY OF THE INVENTION

It is therefore an object of the present invention to provide an automatic performance device which can effectively reduce a memory capacity necessary for storing information related to a chord-based note conversion.

In order to accomplish the above-mentioned object, the present invention provides an automatic performance device which comprises a first storage section for storing a plurality of first automatic performance data and a plurality of second automatic performance data and also storing first information relative to note conversion in corresponding relations to the first automatic performance data, a second storage section for storing second information relative to note conversion common to the second automatic performance data, a readout section for, in accordance with progression of an automatic performance, reading out the first and second automatic performance data and also reading out first information in correspondence with the read-out first automatic performance data and second information in correspondence with the read-out second automatic performance data, and a note conversion section for converting note data contained in the first automatic performance data on the basis of the first information and converting note data contained in the second automatic performance data on the basis of the second information.

In accordance with the progression of an automatic performance, the first and second automatic performance data are read out from the first storage section; when the first automatic performance data is read out, the first note-conversion-related information is read out from the first storage section in correspondence with the readout of the first automatic performance data. When the second automatic performance data is read out, the second note-conversion-related information is read out from the second storage section in correspondence with the readout of the second automatic performance data. Thus, note data conversion processing of note data contained in the first automatic performance data is performed on the basis of the first note-conversion-related information, while note data conversion processing of note data contained in the second automatic performance data is performed on the basis of the second note-conversion-related information.

Therefore, in the case of the first automatic performance data for which it is preferable to perform special note conversion processing, the preferred note conversion processing can be realized by use of the stored first or individual note-conversion-related information. In the case of the second automatic performance data for which it is not necessary to perform special note conversion processing, the note conversion processing can be realized by use of the stored second or common note-conversion-related information, and hence it is possible to eliminate the waste of individually storing the first note-conversion-related information. As a result, the present invention achieves the benefit that in performing the note conversion processing of the plurality of automatic performance data classified into a plurality of attributes, preferred note conversion processing can be realized and yet a necessary memory capacity for the processing can be effectively reduced.

An automatic performance device according to another aspect of the present invention comprises a first storage section for storing a plurality of automatic performance data for a plurality of channels, the first storage section also storing first note-conversion-related information in corresponding relations to at least some individual channels from among the channels, a second storage section for storing second note-conversion-related information independently of the first note-conversion-related information stored in the first storage section, and a note conversion section for reading out the automatic performance data from the first storage section and note-converting the read-out automatic performance data on the basis of the first or second note-conversion-related information, wherein the note conversion section note-converts the read-out automatic performance data on the basis of the first note-conversion-related information for each of the channels for which the first note-conversion-related information is stored in the first storage section, while the note conversion section note-converts the read-out automatic performance data on the basis of the second note-conversion-related information for each of the channels for which the first note-conversion-related information is not stored in the first storage section, so as to generate automatic performance sounds based on note-converted data.

In accordance with the progression of an automatic performance, the automatic performance data are read out from the first storage section; when the automatic performance data corresponding to the at least some individual channels is read out, the first note-conversion-related information is read out from the first storage section in correspondence with the readout of the automatic performance data. When the automatic performance data corresponding to the other channels is read out, the second note-conversion-related information is read out from the second storage section in correspondence with the readout of the automatic performance data. Thus, note data conversion processing of note data contained in the automatic performance data is performed on the basis of the first or second note-conversion-related information.

Therefore, also in this arrangement, for the automatic performance data for which it is not necessary to perform special note conversion processing, the note conversion processing can be realized by use of the stored second or common note-conversion-related information, and hence it is possible to eliminate the waste of individually storing the first note-conversion-related information. As a result, the present invention achieves the benefit that in performing the note conversion processing of the plurality of automatic performance data classified into a plurality of attributes, preferred note conversion processing can be realized and yet a necessary memory capacity for the processing can be effectively reduced.

An automatic performance device according to still another aspect of the invention comprises a first storage section for storing a plurality of automatic performance data, the plurality of automatic performance data being classified into a plurality of attributes, a second storage section for storing first information relative to note conversion of the automatic performance data individually in corresponding relations to predetermined ones of the attributes, a third storage section for storing second information relative to note conversion of the automatic performance data in common to the other attributes, a readout section for reading out the automatic performance data from the first storage section in accordance with progression of an automatic performance, during which time the readout section, in correspondence with readout of first the automatic performance data classified into one of the predetermined attributes, reads out from the second storage section the first information corresponding to the attribute of the first automatic performance data and also, in correspondence with readout of second the automatic performance data classified into one of the other attributes, reads out the second information from the third storage section, and a note conversion section for performing note conversion processing of note data contained in the first automatic performance data on the basis of the first information and performing note conversion processing of note data contained in the second automatic performance data on the basis of the second information, so as to generate note-converted automatic performance sounds.

In the automatic performance device thus arranged, the attributes of the automatic performance data are defined according to at least one of or combination of factors classifying the automatic performance data, such as accompaniment style, accompaniment pattern section and accompaniment sound generation channel or part. The second storage section stores the first information relative to note conversion individually in corresponding relations to predetermined ones of the attributes. However, for the other attributes, such first or individual note-conversion-related information is not stored in the second storage section; in stead, the second information relative to note conversion common to the other attributes is stored in the third storage section.

In accordance with the progression of an automatic performance, the automatic performance data is read out from the first storage section; when the first automatic performance data classified to one of the predetermined attributes is read out, the first note-conversion-related information corresponding to the predetermined attribute is read out from the second storage section in correspondence with the readout of the first automatic performance data. When the second automatic performance data classified into one of the other attributes is read out, the second note-conversion-related information corresponding to the other attribute is read out from the third storage section in correspondence with the readout of the second automatic performance data. Thus, note data conversion processing of note data contained in the first automatic performance data is performed on the basis of the first note-conversion-related information, while note data conversion processing of note data contained in the second automatic performance data is performed on the basis of the second note-conversion-related information.

Therefore, in the case of one attribute for which it is preferable to perform note conversion processing specific to that attribute, the specific note conversion processing can be realized by use of the stored first or individual note-conversion-related information. In the case of another attribute for which it is not necessary to perform note conversion processing specific to that attribute, the note conversion processing can be realized by use of the stored second or common note-conversion-related information, and hence it is possible to eliminate the waste of individually storing the first note-conversion-related information. As a result, the present invention achieves the benefit that in performing the note conversion processing of the plurality of automatic performance data classified into a plurality of attributes, preferred note conversion processing can be realized and yet a necessary memory capacity for the processing can be effectively reduced.

An automatic performance device according to still another aspect of the present invention comprises a first storage section for storing a plurality of first automatic accompaniment data along with first note-conversion-related information, a second storage section for storing a plurality of second automatic accompaniment data, a third storage section for storing second note-conversion-related information common to the plurality of second automatic accompaniment data, and an accompaniment section for executing a predetermined accompaniment by reading out the first automatic accompaniment data and first note-conversion-related information to note-convert the first automatic performance data on the basis of the first note-conversion-related information, and also executing a predetermined accompaniment by reading out the second automatic accompaniment data and second note-conversion-related information to note-convert the second automatic performance data on the basis of the second note-conversion-related information.

In the automatic performance device thus arranged, the first automatic accompaniment data is stored in a group for each performance style, part or section, and the first note-conversion-related information is stored for each group of the automatic accompaniment data. To execute a predetermined accompaniment, the accompaniment section reads out, from the first storage section, the first automatic accompaniment data and first note-conversion-related information of a bass part or chord part in accordance with the progression of a given music piece, so as to convert the read-out first automatic accompaniment data on the basis of the first note-conversion-related information into other notes suitable for the information.

The second storage section, on the other hand, stores the second automatic accompaniment data similar to the data stored in the first storage section, but it stores no note-conversion-related information. The third storage section is provided for storing the second note-conversion-related information for shared use among the plurality of second automatic accompaniment data. Thus, the accompaniment section executes a predetermined accompaniment by reading out the second automatic accompaniment data of the bass or chord part from the second storage section and the second note-conversion-related information from the third storage section in accordance with the progression of a music piece, so as to note-convert the read-out second automatic accompaniment data on the basis of the second note-conversion-related information into other notes suitable for the information.

Thus, in executing the note conversion based on a chord, such automatic accompaniment data to which common note-conversion-related information can be applied without causing any inconvenience may be note-converted on the basis of the second note-conversion-related information. This eliminates a need to store the first note-conversion-related information separately for each of the second automatic accompaniment data and hence can effectively reduce a necessary memory capacity for storing the note-conversion-related information.

For better understanding of various features of the present invention, the preferred embodiments of the invention will be described in detail hereinbelow with reference to the accompanying drawings.

DETAILED DESCRIPTION OF THE PREFERRED EMBODIMENTS

Figure 1:
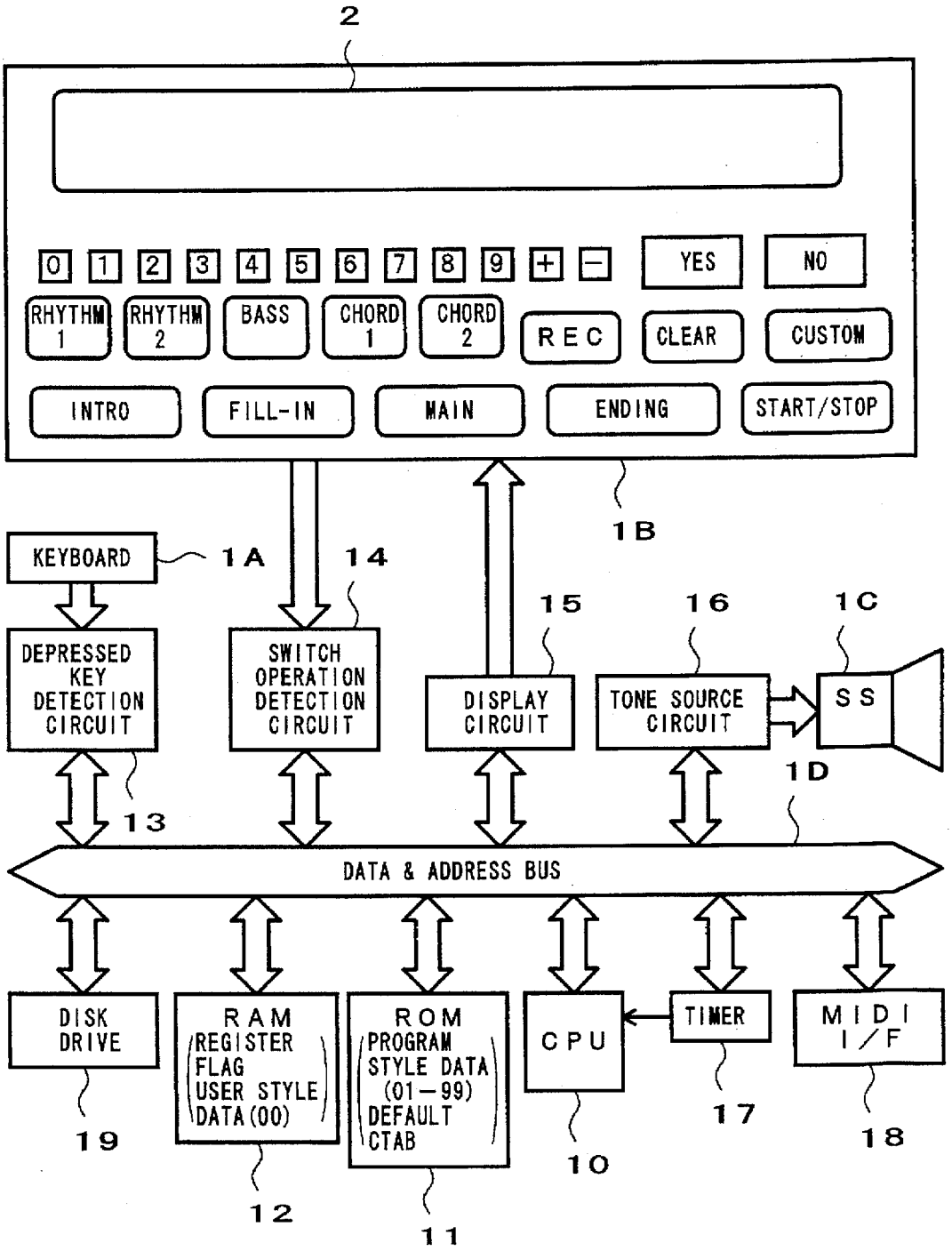
FIG. 1 is a hardware block diagram illustrating the general hardware structure of an embodiment of an electronic musical instrument employing an automatic performance device of the present invention.

FIG. 1 is a hardware block diagram illustrating the general hardware structure of an embodiment of an electronic musical instrument employing an automatic performance device of the present invention. In this embodiment, various processes are performed under the control of a microcomputer including a microprocessor unit (CPU) 10, ROM 11 and RAM 12.

The embodiment will be described hereinbelow on the assumption that various automatic performance processing is carried out by a single CPU 10 and automatic performance tones can be generated simultaneously in 16 automatic performance channels. Namely, in this embodiment, 16 performance data can be simultaneously reproduced for sounding.

The CPU 10 controls the entire operation of the electronic musical instrument and are connected, via a data and address bus 1D, with the ROM 11, RAM 12, depressed key detection circuit 13, switch detection circuit 14, display circuit 15, tone source circuit 16, timer 17, MIDI interface (I/F) 18 and disk drive 19.

In the ROM 11, there are prestored 99 automatic accompaniment style data of style numbers "01" to "99", default channel table (CTAB), note conversion tables and other tone-related parameters and data.

The RAM 12 temporarily stores various performance data and other data arising as the CPU 10 executes programs and is allocated in predetermined address areas of a random access memory for use as registers and flags. The RAM 12 also stores user style data of style number "00" that can be freely used by the operator (i.e., operating person).

It should be obvious that various other automatic performance data than the style data (such as song or melody sequence data, or chord sequence data) are stored in the ROM 11 and/or RAM 12, although these data will not be described specifically. It should also be understood that a chord performance is executed by operating the keyboard 1A in real time simultaneously with an automatic performance, or by reproductively reading out automatic chord performance data from an unillustrated chord sequencer.

Figures 2A, 2B:
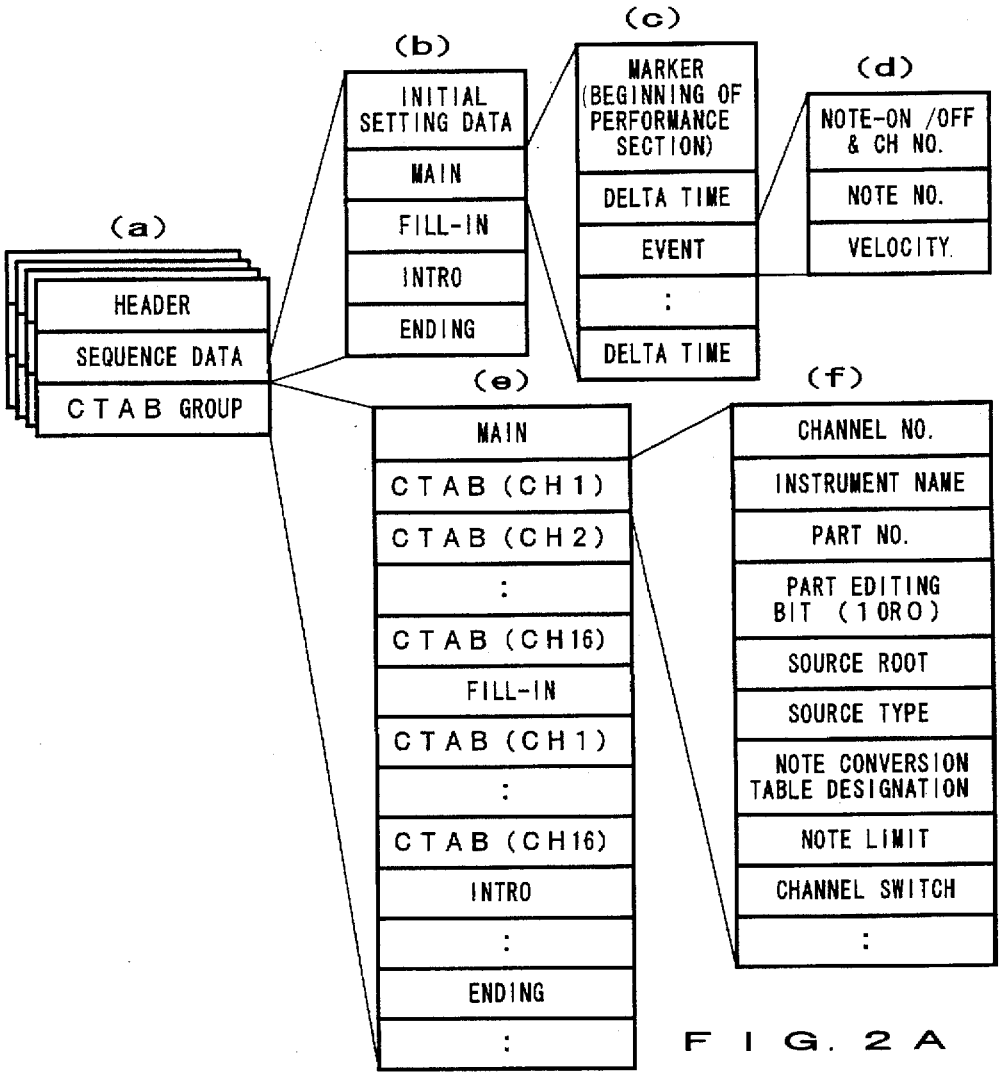
FIG. 2A is a diagram illustrating the contents of style data stored in a ROM and RAM of FIG. 1.
FIG. 2B is a diagram illustrating the contents of a default channel table (CTAB) stored in the ROM of FIG. 1.

FIGS. 2A and 2B are diagrams illustrating the respective contents of the style data and default channel table (CTAB) stored in the ROM and RAM of FIG. 1. The RAM 12 stores the user style data of style number "00", and the ROM 11 stores the 99 style data of style numbers "01" to "99" and default channel tables (CTABs). The style data are stored for each of predetermined performance styles such as pops, rock-and-roll, jazz and waltz.

As shown at (a) of FIG. 2A, each style data is comprised of a header portion, sequence data portion and channel table group. The header portion contains the name of the style etc.

As shown at (b) of FIG. 2A, the sequence data section is comprised of initial setting data, and pattern data for individual performance sections (main, fill-in, intro and ending sections). The initial setting data includes data indicative of tone color, performance part name, initial tempo etc. of each of the channels. The main pattern data represents a main accompaniment pattern to be repetitively performed in an automatic performance; the fill-in pattern data represents an accompaniment pattern for a fill-in performance; the intro pattern data represents an accompaniment pattern for an intro performance, and the ending pattern data represents an accompaniment pattern for an ending performance.

As shown at (c) of FIG. 2A, the pattern data of each of the above-mentioned performance sections includes marker data, delta time data and event data. The marker data represents the beginning or end (in this embodiment, beginning) of a performance section and identifies the type of that performance section such as the main, fill-in, intro or ending section. The default time data represents a time between events. As shown at (d) of FIG. 2A, note event data includes data representative of a note-on/note-off event, channel number (one of numbers "1" to "16"), note number and velocity. Other event data (such as pitch bend and volume control event data) also include data representative of the type of the event and channels number. The delta time data and event data are stored in pairs, and the delta time data takes a value "0" in the case of same-timing events.

Further, as shown at (e) of FIG. 2A, the channel table (CTAB) group comprises a plurality of channel tables (CTABs) relative to note conversion which are stored separately in corresponding relations to the 16 channels, for each of the main, fill-in, intro and ending sections. The reason why the channel tables (CTABs) are stored separately for the individual channels of every performance section is that it is preferable to differentiate, among the channels, the optimum condition under which notes should be converted on the basis of a chord designated by the operator operating the keyboard keys or reproductively read out from the chord sequencer.

Although in principle it is preferable that the channel table (CTAB) is provided for each channel of every performance section (channel-specific or individual channel table (CTAB)), providing such a channel table for each of the channels in those performance section which do not need any special setting for the note conversion processing will require increased memory capacity and hence is not preferable. For this reason, such a table is actually not provided for all or one or more channels in one or more performance sections of one or more performance styles. In those channels with no channel table (CTAB), necessary note conversion is effected by use of the default channel table (CTAB) that is stored in the ROM 11 for shared use among the channels (hence, the default channel table (CTAB) may be called a "common channel table", as compared to the channel-specific channel tables (CTABs)). Thus, for automatic performance data classified into specific types of attributes (i.e., automatic accompaniment data which do not any special setting for the note conversion processing), it is possible to reduce the necessary data storage capacity by using the common default channel table as shown in FIG. 2B.

Necessary data storage capacity in the memories can be substantially reduced by thus storing a plurality of performance styles which have one or more channels with no channel-specific channel tables (CTABs) and allowing such styles to use the default channel table (CTAB). It should be appreciated that the default channel table (CTAB) may be shared among all the performance sections or all the channels of a given style, or only among some selected performance styles or channels. In such a case, the performance styles sharing the default channel table (CTAB) may be those stored in the ROM 11 or stored in the RAM 11 by the user.

More specifically, in the case of predetermined ones of the styles of style numbers "00" to "99", the channel-specific channel table as shown at (e) of FIG. 2A is not provided for all or one or more of the channels; instead, the common default channel table is used for such channels.

Namely, the common default channel table may be applied to every channel of every performance section of a given performance style, or to every channel of one or more performance sections of a given performance style, or to one or more channels of one or more performance sections of a given performance style. Alternatively, it is possible that the common default channel table is applied to every channel of every performance section for predetermined performance styles, but is applied to one or more channel of one or more performance section for the other performance styles. Further, the performance styles to which the common default channel table is applied may be stored in the ROM 11 or in the RAM 12.

As shown at (f) of FIG. 2A, each of the channel-specific channel tables (CTABs) comprising the channel table group at (e) of FIG. 2A includes data representative of a channel number, musical instrument name, part number, part editing bit, source root, source type, note conversion table to be used (note-conversion-table designation data), note limiting range data and channel switch data.

The channel number is any one of numbers "1" to "16", and the channel numbers are different from each other in the channel tables (CTABs) of each performance section.

The musical instrument name corresponds to a tone color to be set in one of the MIDI channels of the tone source circuit 16 which is designated by the channel number.

The part number indicates particular one of the performance parts which the performance data relates to and takes any one of values "1" to "5" Part number "1" represents a rhythm 1 part; part number "2" represents a rhythm 2 part; part number "3" represents a bass part; part number "4" represents a chord 1 part; and part number "5" represents a chord 2 part.

The part editing bit (PEB) takes one of values "0" and "1" indicating whether or not the corresponding channel may be edited on a part-by-part basis. If the part editing bit is "1", it means that the part editing is not permitted because the performance part is composed of a plurality of channels (and thus it can not be determined which of the channels should be edited in what manner in order to attain musically preferable editing), whereas if the part editing bit is "0", it means that the part editing is permitted because the performance part is composed of a single channel. Even where the performance part is composed of a single channel, the part editing bit (PEB) is sometimes set to "1" when editing of that channel should not be executed for a certain reason.

The source route data indicates a chord root on the basis of which the sequence data (automatic accompaniment data) of the channel was prepared, and the default value of this source route is "C" in the embodiment. The source type data indicates a chord type on the basis of which the sequence data (automatic accompaniment data) of the channel was prepared, and the default value of this source type is "C major 7th" in the embodiment.

Irrespective of the chord root and chord type on which the sequence data (automatic accompaniment data) of the channel is based, the sequence data of that channel can be converted into C major 7th notes, i.e., reference notes to be used for note conversion.

The note-conversion-table designation data indicates which of the note conversion tables is to be used .for note conversion. For example, there are L bass-part note conversion tables (i.e., bass-part note conversion table 1 to bass-part note conversion table L) suitable for the bass part, M chord-part note conversion tables (i.e., chord-part note conversion table 1 to chord-part note conversion table M) suitable for the chord part, etc. The note-conversion-table designation data designates a specific one of the above-mentioned tables in accordance with which note conversion is effected or that no conversion is to be effected. The defaults of the note-conversion-table designation data in the embodiment are: "no conversion" for the rhythm parts; "bass-part note conversion table 1" for the bass part; and "chord-part note conversion table 1" for the chord parts.

The note limiting range data designates the upper and lower limits of a predetermined pitch range within which note numbers having been converted by the note conversion process should fall or be confined.

The channel switch data represents a memory switch which activates tone generation in the corresponding channel when the root and and type of a chord being currently depressed are of predetermined kind, and takes a value "0" or "1" which indicates ON/OFF with respect to every possible chord root and chord type. In the case where a specific performance part comprises a plurality of channels, the use of the channel switch allows a channel change depending on the chord type. The default of this channel switch data in the embodiment is "all of the channels are normally allowed to generate tone".

As shown in FIG. 2B, the common default channel table (CTAB) contains, for each of the channels, data representative of a channel number CH, part number, part editing bit (PEB), source root, source type, note conversion table to be used (note conversion table designation data), note limiting range and channel switch, similarly to the channel-specific channel table (CTAB) described above in relation to item (f) of FIG. 2A. In this embodiment, the default values are set for channels CH1 to CH5, but no default values are set for channels CH6 to CH16. No musical instrument name is set in the default channel table.

For the part number data in the default channel table, the rhythm 1 part of part number "1" is allocated to channel CH1, the rhythm 2 part of part number "2" is allocated to channel CH2, the bass part of part number "3" is allocated to channel CH3, the chord 1 part of part number "4" is allocated to channel CH4, and the chord 2 part of part number "5" is allocated to channel CH5. The part editing bit is set at "0" for all of channels CH1 to CH5.

Further, in the default channel table, the source root data is set at "C" for all of channels CH1 to CH5. The source type is set at "Major 7th" for all of channels CH1 to CH5.

For the note conversion table designation data in the default channel table, "no conversion" is set to channels CH1 and CH2 of the rhythm part, the bass-part note conversion table 1 is set to channel CH3 of the bass part, and the chord-part note conversion table 1 is set to channels CH4 and CH5.

No note limiting range is set in the default channel table. Although not shown specifically, the channel switch data is set at "tone should normally be generated in all of the channels".

The keyboard 1A is provided with a plurality of keys for designating the pitch of each tone to be generated and includes key switches corresponding to the individual keys. If necessary, the keyboard 1A may also include a touch detection means such as a key depressing force detection device. Although described here as employing the keyboard 1A that is a fundamental performance operator relatively easy to understand, the embodiment may of course employ any performance operating member other than the keyboard 1A.

The depressed key detection circuit 13 includes key switch circuits that are provided in corresponding relations to the pitch designating keys of the keyboard 1A. This depressed key detection circuit 13 outputs a key-on event signal upon its detection of a change from the released state to the depressed state of a key on the keyboard 1A, and a key-off event signal upon its detection of a change from the depressed state to the released state of a key on the keyboard 1A. At the same time, the depressed key detection circuit 13 outputs a key code (note number) indicative of the key corresponding to the key-on or key-off event. The depressed key detection circuit 13 also determines the depression velocity or force of the depressed key so as to output velocity data and after-touch data.

The switch operation detection circuit 14 is provided, in corresponding relations to various operating members (switches) provided on the operation panel 1B, for outputting, as event information, operation data responsive to the operational states of the individual operating members.

The display circuit 15 controls information to be displayed on a display device (LCD 2) provided on the operation panel 1B.

As mentioned earlier, various operating members and LCD 2 are provided on the operation panel 1B. The operating members on the operation panel 1B include style selecting switches having numerical indications "0" to "99" and signs "+" and "–" attached on their respective surfaces, "YES" switch, "NO" switch, part selecting switches "RHYTHM1", "RHYTHM2", "BASS", "CHORD1" and "CHORD2", section selecting switches "INTRO", "FILL-IN", "MAIN" and "ENDING", recording switch "REC", "CLEAR" switch, "CUSTOM" switch and "START/STOP" switch. Various other operating members than the above-mentioned are also provided on the operation panel 1B for selecting, setting and controlling color, volume, pitch, effect etc. of each tone to be generated, but only those operating members necessary in the embodiment will be described.

Any one of the style numbers can be selected by entering its unique style number (i.e., one of style numbers "00" to "99") by activating the corresponding style selecting switch or switches. The name of the style selected by use of the corresponding selecting switch or switches is shown on the LCD 2. The "YES" and "NO" switches allow the operator to reply to a message from the musical instrument displayed on the LCD 2.

The part selecting switches are for selecting any one of the performance parts to be edited, and the section selecting switches are for selecting any one of the performance sections to be edited. The "RECORDING" switch is for designating a mode to edit the performance data of the performance section and part selected by use of the section and part selecting switches. In this embodiment, when the "RECORDING" and part selecting switches are activated at the same time, the musical instrument is placed in the mode to edit the performance data in the thus-selected performance part.

The "CLEAR" switch is for deleting the performance data placed in the editing mode. The custom switch is for copying, as the user style data of style number "00", the data of one of style numbers "01" to "99" which is selected by the style selecting switch, into a custom area of the RAM 11. Further, the START/STOP switch is for controlling a start/stop of an automatic performance.

The tone source circuit 16, which is capable of simultaneously generating tone signals in 16 channels in the embodiment, receives MIDI-based performance data supplied via the data and address bus ID and generates tone signals on the basis of the received performance data.

The tone source circuit 16 may employ any of the conventionally-known tone signal generation systems, such as the memory readout system where tone waveform sample value data prestored in a waveform memory are sequentially read out in response to address data varying in accordance with the pitch of tone to be generated, the FM system where tone waveform sample value data are obtained by performing predetermined frequency modulation using the above-mentioned address data as phase angle parameter data, or the AM system where tone waveform sample value data are obtained by performing predetermined amplitude modulation using the above-mentioned address data as phase angle parameter data.

Each tone signal generated from the tone source circuit 16 is audibly reproduced or sounded via a sound system 1C comprised of amplifiers and speakers.

The timer 17 generates tempo clock pulses to be used for counting a time interval and for setting an automatic performance tempo. The frequency of the tempo clock pulses is adjustable by a tempo switch (not shown) provided on the operation panel 1B. Each generated tempo clock pulse is given to the CPU 10 as an interrupt command, and the CPU 10 in turn executes various automatic performance processes as timer interrupt processes. In this embodiment, it is assumed the frequency is selected such that 96 tempo clock pulses are generated per quarter note.

The MIDI interface (I/F) 18 and disk drive 19 are for outputting performance data to outside the musical instrument and introducing performance data from outside. It should be obvious that performance data may be exchanged via a public communication line or network, HDD (hard disk drive) or the like rather than the above-mentioned means.

Now, various processes performed by the CPU 10 in the electronic musical instrument will be described in detail on the basis of the flowcharts shown in FIGS. 3 to 7.

Figure 3:
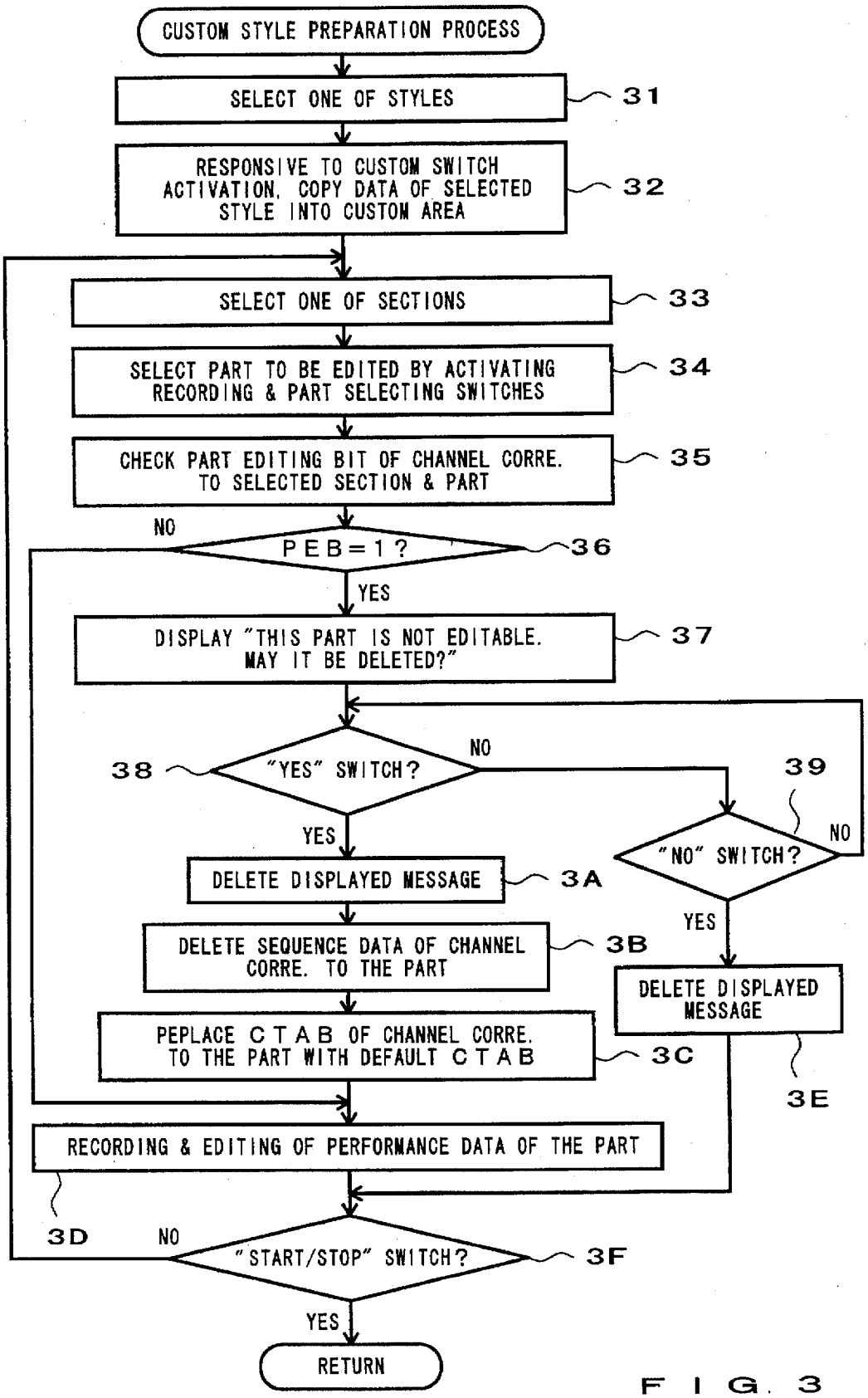
FIG. 3 is a flowchart illustrating an example of a custom style preparation process performed by a CPU in the electronic musical instrument of FIG. 1 in response to an operator's switch activation on an operation panel.

FIG. 3 is a flowchart illustrating an example of a custom style preparation process performed by the CPU 10 in the electronic musical instrument of FIG. 1 in response to the operator's switch activation on the operation panel 1B. This custom style preparation process is executed by the operator in order to prepare user style data of style number "00". The custom style preparation process is carried out in the following step sequence.

Step 31: Desired one of style numbers "00" to "99" is selected by the operator activating any of the style selecting switches "0" to "9" and "+" or "–" to enter the desired style number while looking at the screen of the LCD 2.

Step 32: In response to the operator's activation of the "CUSTOM" switch, the CPU 10 copies, as user style data, the performance data of the style number selected at step 31, into the custom area of the RAM 11.

Step 33: One of the section selecting switches "INTRO", "FILL-IN", "MAIN" and "ENDING" which corresponds to a performance section to be edited is selected by the operator.

Step 34: While activating the "REC" switch, the operator activates one of the part selecting switches which corresponds to one of the performance parts to be edited.

Step 35: In response to the operator's switch activation at steps 33 and 34, the CPU 10 checks the part editing bit (PEB) corresponding to the selected performance section and part. Namely, the CPU 10 reads the part editing bit (PEB) of the channel corresponding to the selected part number from, among the channel tables (CTAB) of the selected performance section.

Step 36: A determination is made as to whether the part editing bit (PEB) read at step 35 is at value "1". If answered in the affirmative, the CPU 10 proceeds to next step 37, but if not, the CPU 10 jumps to step 3D.

Because the determination at step 36 that the part editing bit read at step 35 is at value "1" means that the performance data of the part selected at steps 33 and 34 is not editable, the CPU 10 displays on the LCD 2 a message "This performance is not editable. May it be deleted?".

Step 38: The operator activates the "YES" or "NO" switch in reply to the message displayed on the LCD 2, and then the CPU 10 determines whether the "YES" switch has been activated. If the "YES" switch has been activated, the CPU 10 goes to next step 3A; otherwise, the CPU 10 branches to step 39.

Step 39: Because of the determination at step 38 that the "YES" switch has not been activated, a further determination is made at this step as to whether the "NO" switch has been activated by the operator. If the "NO" switch has been activated, the CPU 10 goes to next step 3E; otherwise, the CPU 10 loops back to step 38.

In this way, the determination at steps 38 and 39 are repeated until either the "YES" switch or the "NO" switch has been activated.

Step 3A: Now that it has been determined at step 38 that the "YES" switch has been activated, the above-mentioned message is deleted from the LCD 2.

Step 3B: The sequence data of the channel corresponding to the performance part selected at steps 33 and 34 is deleted. Namely, the sequence data is remade by searching the sequence data for events related to the channel number and deleting these events. Where the performance part in question is composed of a plurality of the channels, the sequence data of all these channels are deleted.

Step 3C: The CPU 10 replaces the channel table of the channel corresponding to the performance part selected at steps 33 and 34, with the default channel table contained in the ROM 11. In this replacement, data specific to the channel table such as the channel number, musical instrument name and part number are left unchanged, and only values other than these are changed into values of the default channel table.

Step 3D: The operator records and edits the new sequence data in place of the old sequence data deleted at step 3B. Preparation, recording and editing of the new sequence data are performed in a real-time input process responsive to switch activation on the keyboard 1A (overdubbing process) and step input process, clear process and quantize process responsive to activation of other switches not shown in the drawings.

Step 3E: Now that the operator has activated the "NO" switch as determined at step 39, the CPU 10 deletes the above-mentioned message from the LCD 2.

Step 3F: A determination is made as to whether the "START/STOP" switch has been activated. If answered in the affirmative, the CPU 10 returns to a main routine (not shown), but if the the "START/STOP" switch has not been activated, the CPU 10 loops back to step 33 to repeat the operations at and after step 33.

Figure 4:
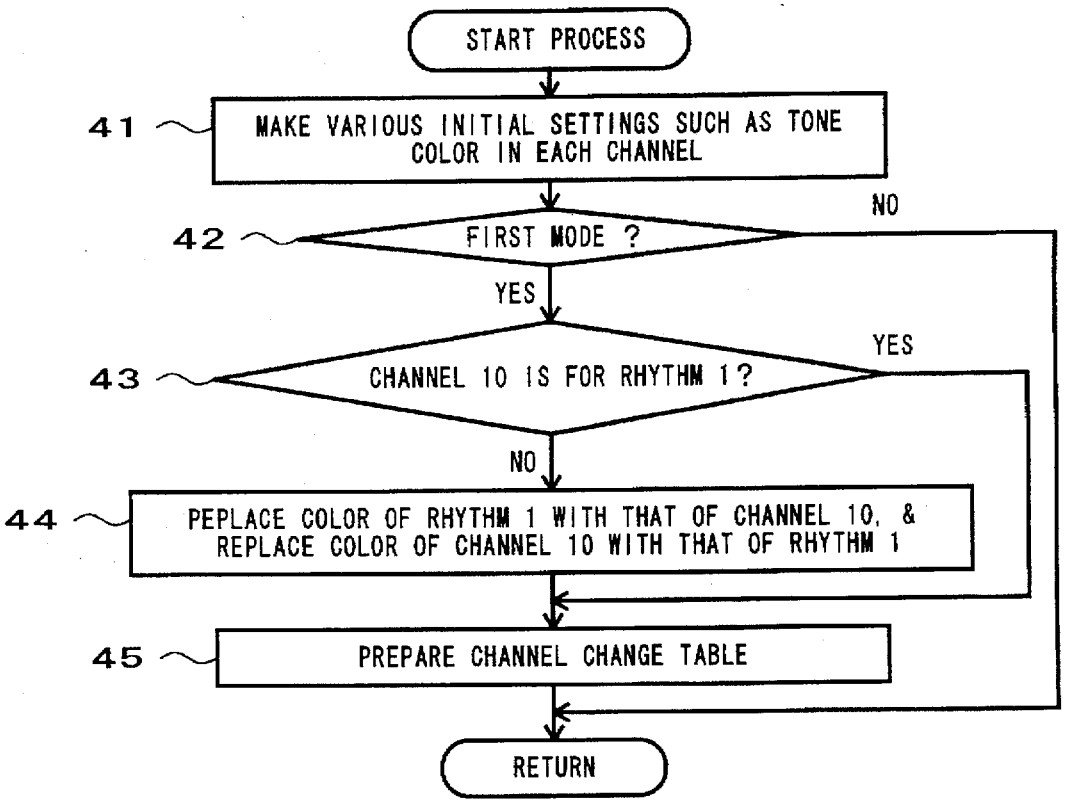
FIG. 4 is a flowchart illustrating an example of a start process performed by the CPU when the operator activates a start/stop switch on the operation panel to instruct an automatic performance start.

FIG. 4 is a flowchart illustrating an example of a start process performed by the CPU 10 when the operator has activated the "START/STOP" switch on the operation panel 1B to instruct an automatic performance start. In this start process, specific operations are executed to allow tones to be generated without any significant interference, even where the electronic musical instrument has a plurality of rhythm parts (rhythm 1 part and rhythm 2 part) as in this embodiment and even where the tone source circuit 16 is capable of generating tones of the two rhythm parts in MIDI channels independently of each other and is a GM (General MIDI) system tone source in which tones of the rhythm parts are fixedly allocated to a single MIDI channel of channel number "10".

More specifically, in the case where there exist two rhythm parts such as the rhythm 1 part and rhythm 2 part and the tone source circuit 16 is a GM system tone source, tones of the two rhythm parts must both be output to MIDI channel number "10" In such a case, when there has occurred a plurality of events (such as high-hat open and high-hat close events, or same-type events of different velocity) where tones must not be generated from the two parts at the same timing), one of the two events output after the other will be sounded with priority over the other (preceding) event. Thus, this embodiment is designed in such a manner that one of the plurality of rhythm parts is set as a main rhythm part and the other as a subordinate rhythm part and that when events have occurred at the same timing, the main rhythm part event is output last. This arrangement permits the main rhythm part tone to be generated without fail and hence avoids the inconvenience that the main part performance tone fails to sound, thus attaining a musically preferable performance.

This start process is carried out in the following step sequence.

Step 41: Various tone-related settings as tone color are made with respect to the individual MIDI channels of the tone source circuit 16 on the basis of the initial setting data as shown at (b) Of FIG. 2A.

Step 42: It is determined whether nor not the current mode is a first tone generation mode. If it is the first tone generation mode, the CPU 10 proceeds to next step 43, but if it is a second tone generation mode, the CPU 10 returns to the main routine. The first tone generation mode is a mode to sound the performance data of the rhythm 1 and rhythm 2 parts after being merged together as performance data of a single MIDI channel, whereas the second tone generation mode is a mode to sound the performance data of the rhythm 1 and rhythm 2 parts as performance data of separate MIDI channels. Desired one of the tone generation modes may be set by the operator activating an unillustrated mode selecting switch or may be set automatically in response to a determination as to whether or not the tone source circuit 16 is a GM system tone source. In the latter case, if the tone source circuit 16 is a GM system tone source, the first tone generation mode is selected; otherwise, the second tone generation mode is selected.

Step 43: It is determined whether channel number "10" is assigned to the rhythm 1 part. If answered in the affirmative, the CPU 10 jumps to step 45, but if channel number "10" is assigned to another performance part than the rhythm 1 part, the CPU 10 proceeds to step 44.

Step 44: Now that it has been determined at step 43 that the channel number assigned to the rhythm 1 part is "n" and not "10", the tone color of channel number "n" is replaced with that of channel number "10" and the tone color of channel number "10" is replaced with that of the rhythm 1 part. Namely, the tone colors of channel numbers "10" and "n" are exchanged.

Step 45: A channel change table is prepared such that the performance data of the rhythm 1 and rhythm 2 parts are set to channel number "10". That is, if step 43 has determined that channel number "10" is assigned to the rhythm 1 part, a channel change table for the rhythm 2 part is prepared for shifting the performance data of the rhythm 2 part to channel number "10". If, on the other hand, step 43 has determined that channel number "10" is not assigned to the rhythm 1 part and the tone color exchange has been effected at step 44, a channel change table is prepared such that the performance data of the rhythm 1 and rhythm 2 parts are both set to channel number "10". Further, if channel number "10" is assigned to the rhythm 2 part at the time of determination at step 43, the tone color exchange is effected at step 44 and then a channel change table is prepared for the rhythm 1 part.

Figure 5:
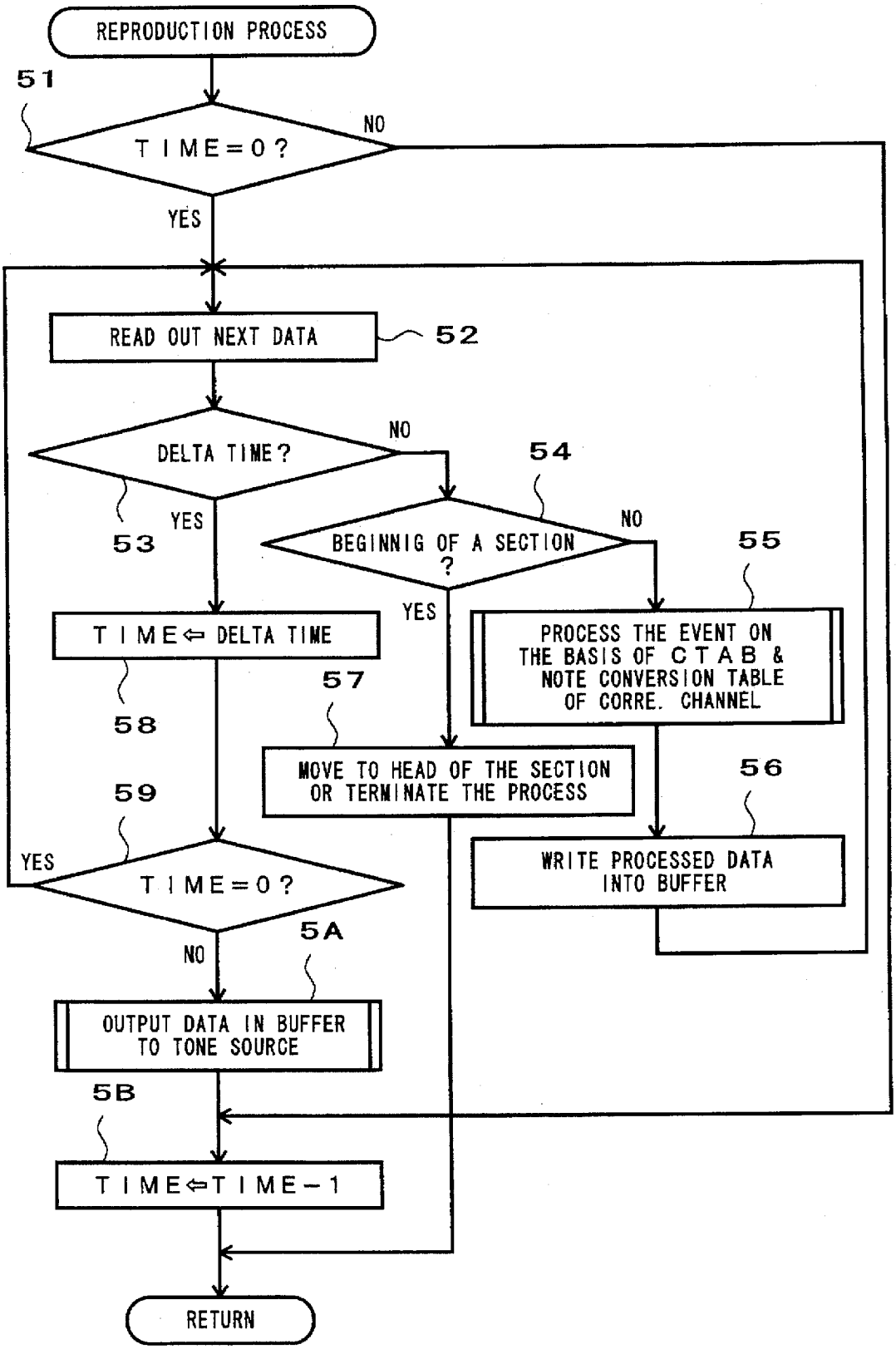
FIG. 5 is a flowchart illustrating an example of a reproduction process performed in response to a timer interrupt signal at a frequency of 96 times per quarter note.

FIG. 5 is a flowchart illustrating an example of a reproduction process performed in response to timer interrupt signals at a frequency of 96 times per quarter note. This reproduction process is carried out in the following step sequence.

Step 51: A determination is made as to whether the current value stored in timing register TIME is "0" or not. If the stored value is "0", it means that predetermined timing to read out next data from among the sequence data shown at (a) of FIG. 2A has arrived, and hence the CPU 10 proceeds to step 52, but if the stored value is other than "0", the CPU 10 jumps to step 5B.

Step 52: Now that sequence data readout timing has arrived as determined at step 51, the next data is read out from among the sequence data.

Step 53: A determination is made as to whether the read-out data is delta time data. If answered in the affirmative, the CPU 10 proceeds to step 58, but if the read-out data is not delta time data, the CPU 10 branches to step 54.

Step 54: Now that the read-out data is not delta time data as determined at step 53, it is further determined whether or not the read-out data is marker data indicative of the beginning of one of the performance sections. If answered in the affirmative, the CPU 10 proceeds to step 57, but if the read-out data is not marker data, the CPU 10 branches to step 55.

Step 55: Because the determination at step 54 that the read-out data is not marker data means that the data read out at step 52 is event data, the read-out event is processed on the basis of the channel table and note conversion table of the corresponding channel. However, in the case of other events than the note event, the operation of this step is skipped.

Figure 6:
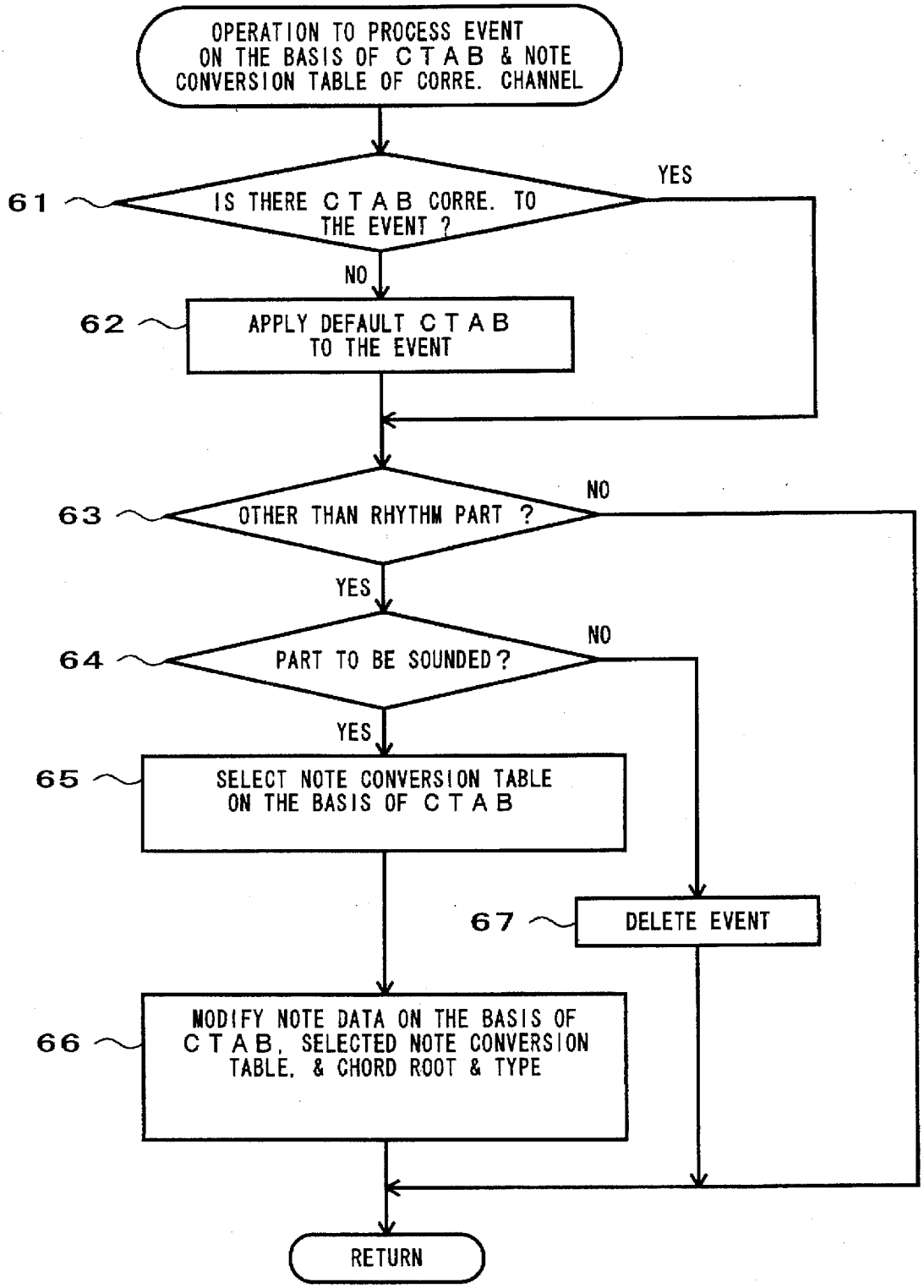
FIG. 6 is a flowchart illustrating the detail of the operation at step 55 in the reproduction process of FIG. 5.

FIG. 6 is a flowchart illustrating the detail of the operation of step 55 in the reproduction process of FIG. 5, which is carried out in the following step sequence.

Step 61: It is determined whether or not a channel table corresponding to the note event data read out at step 52 is present in the channel-specific channel table group ((a) of FIG. 2A), on the basis of the performance section being currently performed and channel number in the event data. If such a table is present in the channel table group, the CPU 10 jumps to step 63; otherwise the CPU 10 proceeds to step 62.

Step 62: Because of the determination at step 61 that no channel table corresponding to the note event data read out at step 52 is present in the channel-specific channel table group ((a) of FIG. 2A), the default channel table is applied here as a channel table corresponding to the event. More specifically, if the automatic accompaniment data represents a sound of one of the rhythm parts, channel 1 or 2 is assigned thereto and the channel number in the event data is "1" or "2", so that the default channel table (FIG. 2B) for channel 1 or 2 is selected accordingly. If the automatic accompaniment data represents a sound of the bass part, channel 3 is assigned thereto and the channel number in the event data is "3", so that the default channel table (FIG. 2B) for channel 3 is selected accordingly. Further, if the automatic accompaniment data represents a sound of one of the chord parts, channel 4 or 5 is assigned thereto and the channel number in the event data is "4" or "5", so that the default channel table (FIG. 2B) for channel 4 or 5 is selected accordingly.

As may be obvious from the foregoing, in the case where the common default channel table (FIG. 2B) is to be applied, the common default channel table is selected in response to the channel number in the event data, irrespective of the type of the performance style or performance section. The chord-part default channel table is provided separately for two channels in the example of FIG. 2B, but in a modified example, the same chord-part default channel table may be selected irrespective of the channel number. namely, the chord-part default channel table may provided for only one channel so that the same chord-part default channel table is selected irrespective of whether the channel number in the event data is "4" or "5".

Step 63: If there exits a channel-specific channel table in the table group ((a) of FIG. 2A) to be applied on the basis of the channel number in the event data, the CPU 10 refers to the channel-specific channel table corresponding to the channel; otherwise the CPU 10 refers to the common default channel table corresponding to the channel. Then, a determination is made, on the basis of the part number in the referred-to channel table, as to whether the channel table is not for the rhythm part but for the bass or chord part. If answered in the affirmative, the CPU 10 proceeds to step 64, but if the channel table is for the rhythm part, the CPU 10 goes to step 56 of FIG. 5.

At and after step 63, predetermined operations are performed with reference to the stored contents of the corresponding channel-specific or common default channel table ((a) of FIG. 2A or FIG. 2B) to be applied on the basis of the channel number in the event data.

Step 64: "channel switch data" is read out from the corresponding channel table in response to the current chord root and chord type performed on the keyboard 1A or read out from the chord sequencer. Then, a determination is made as to whether or not the switch channel data corresponding to the current chord root and type is "1", i.e., whether or not the performance part is to be sounded. If the switch channel data is "1" meaning that the performance part is to be sounded, then the CPU 10 proceeds to next step 65, but if the performance part is not to be sounded, the CPU 10 branches to step 67.

Step 65: "note conversion table designation table" is read out from the corresponding channel table, and predetermined one of the note conversion tables is selected in accordance with the note conversion table designation data.

Step 66: Note conversion processing is performed to modify the note data on the basis of data in the channel table, selected note conversion table, and root and type of the chord being currently performed by the operator or chord root and type reproductively read out by the chord sequencer. If the source root and source type in the channel table are not of C Major 7th, the note data is first converted so as to correspond to C Major 7th and then further modified on the basis of the note conversion table and the current chord root and type. In the event that a tone falling outside the pitch range defined by the note limiting range data contained in the channel table, the note data is modified by the octave so that the tone falls within the defined pitch range. Also, if the channel switch data indicates that no tone should be generated in the current chord root and/or type, this note will not be sounded. After this note conversion, the CPU 10 proceeds to step 56.

Step 56: The note event having a note number changed at step 55 (operation of FIG. 6) is written into a buffer, and then the CPU 10 returns to the main routine.

Step 57: Because step 54 has determined that the data read out at step 52 is marker data indicating the beginning of the performance section, the CPU 10 moves to the head of the performance section as designated by the marker data, or terminates the process. In the case where the CPU 10 moves to the head of the performance section, first delta time data in the performance section is read out to be stored into the timing register TIME, and then the CPU 10 waits until next timer interrupt timing.

Step 58: Now that the read-out data is delta time data as defined at step 53, the delta time data is stored into the timing register TIME.

Step 59: A determination is made as to whether the current value stored in the timing register TIME is "0" or not, i.e., whether or not the delta time data read out at step 52 is "0". If the delta time data is "0", it indicates same-timing events, and hence the CPU 10 reverts to step 52 to read out the event data corresponding to the delta time and then executes the operations of steps 54 to 57. But if the stored value is other than "0", the CPU 10 jumps to step 5A.

Step 5A: The data stored in the buffer is output to the tone source circuit 16, and then the CPU 10 proceeds to step 5B.

Step 5B: Now that the current value stored in the timing register TIME is not "0" as determined at step 51, or at step 59 after a value other than "0" has been stored into the timing register TIME at step 58, the CPU 10 returns to the main routine after decrementing the stored value in the register TIME by one and waits until next timer interrupt timing.

Figure 7:
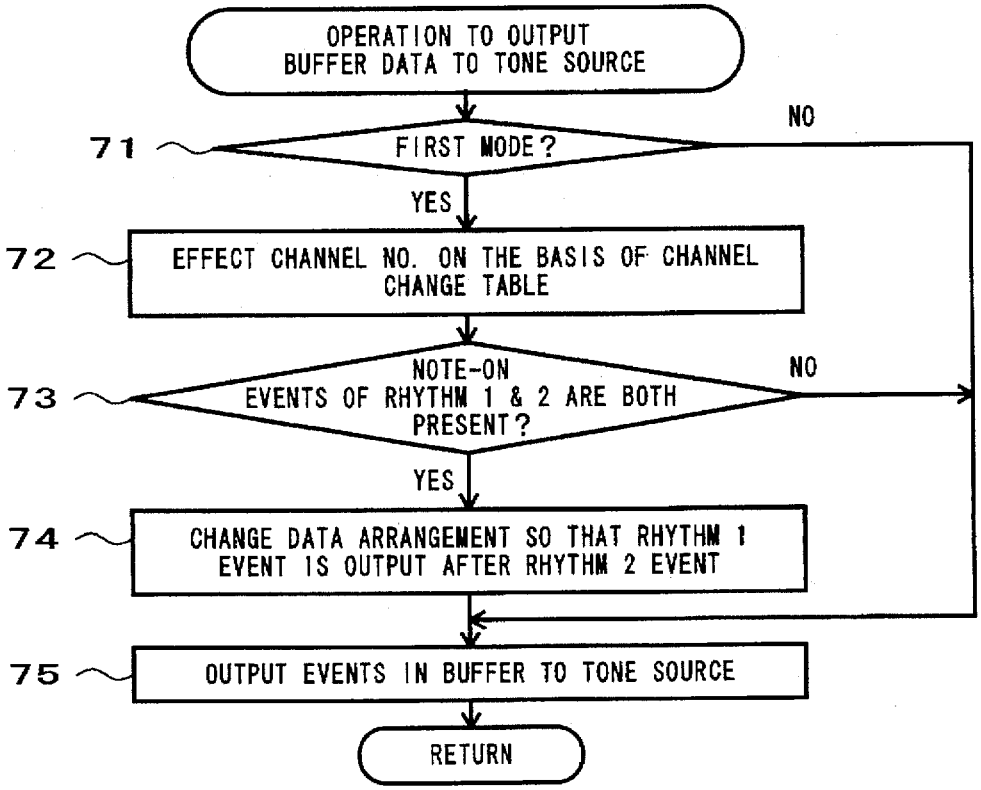
FIG. 7 is a flowchart illustrating the detail of the operation at step 5A in the reproduction process of FIG. 5.

FIG. 7 is a flowchart illustrating the detail of the operation of step 5A, which is performed in the following step sequence.

Step 71: It is determined whether nor not the current mode is the first tone generation mode. If it is the first tone generation mode, the CPU 10 proceeds to next step 72, but if it is the second tone generation mode, the CPU 10 jumps to step 75.

Step 72: Now that the current mode is the first tone generation mode as determined at step 71, a channel number change is effected on the basis of the channel change table prepared at step 45 of FIG. 4, so that the channel numbers of the events in the rhythm 1 and rhythm 2 parts are changed to "10".

Step 73: A determination is made as to whether note-on events of the rhythm 1 and rhythm 2 parts are present in the buffer. If answered in the affirmative, the CPU 10 proceeds to step 74; otherwise the CPU 10 jumps to step 75.

Step 74: The data arrangement in the buffer is changed in such a manner that the note event of the rhythm 2 part is output ahead of the note event of the rhythm 1 part. Namely, in this embodiment, the rhythm 1 part has higher importance than the rhythm 2 part.

Step 75: The note-on events in the buffer are output to the tone source circuit 16 in accordance With the rearranged data sequence, and then the CPU 10 waits until next timer interrupt timing.

Thus, even where events have occurred from the rhythm 1 and rhythm 2 parts at the same timing, the above-mentioned operations of steps 74 and 75 allows the event of the rhythm 1 part to be output after that of the rhythm 2 part. Consequently, if the events of the two rhythm parts occur at the same timing and have characteristics incompatible with each other (e.g., where the two events are high-hat open and high-hat close events, or same-type events that are different only in velocity), the tone source circuit 16 is caused to preferentially generate only a tone corresponding to the event of the rhythm 1 part.

Although the embodiment has been described above in connection with a case where the respective note event output timing of the rhythm 1 and rhythm 2 parts is adjusted, the note event of the rhythm 2 part may be deleted if the events of the two rhythm parts are incompatible with each other.

Further, whereas the embodiment has been described above in connection with an electronic musical instrument containing a tone source circuit and an automatic performance device, the present invention is also applicable to such an electronic musical instrument in which a sequencer module executing an automatic performance process and a tone source module including a tone source circuit are provided separately from each other and data is exchanged between the two modules in accordance with the well-known MIDI standards.

Furthermore, whereas the embodiment has been described above in connection with a case where the principle of the present invention is applied to an automatic accompaniment performed by repetitively reading out performance data of rhythm, bass, chord parts etc., it should be obvious that the present invention may also be applied to an sequencer-type automatic performance where a series of automatic performance data such as of a melody is sequentially read out for audible reproduction.

The embodiment has been described as setting note conversion table designation data in each of the channel-specific channel change table so as to designate one of the note conversion tables. In an alternative embodiment, predetermined note conversion table itself may be stored in each of the channel-specific channel change table.

Moreover, whereas the embodiment has been described above in connection with a case where information relative to note conversion is provided for each channel, such note-conversion-related information may be provided for each of the performance sections or styles. More specifically, in the above-described embodiment, the attributes are defined according to the combination of the accompaniment style, accompaniment pattern section and accompaniment sound channel, and the note conversion-related information (i.e., channel table information as shown at (e) and (f) of FIG. 2A) is stored in correspondence with the thus-defined attributes (i.e., in correspodence with the accompaniment styles, sections and channels). Alternatively, the attributes may be defined according to only one of the accompaniment style, accompaniment pattern section and accompaniment sound, and the note conversion-related information (i.e., channel table information as shown at (e) and (f) of FIG. 2A) may be stored for each of the thus-stored attributes. Also in such a case, no individual note-conversion-related information (channel table) is of course not stored in correspondence with a plurality of the attributes for which common note-conversion-related information (i.e., default channel table information).

Furthermore, in the above-described embodiment, presence or absence of note-conversion-related information (individual channel information) is detected at step 61 of FIG. 6, and such note-conversion-related information is used if present, but common note-conversion-related information (i.e., default channel table information) is used at step 62 of FIG. 6 if no such individual note-conversion-related information is present. Alternatively, instruction as to whether the common note-conversion-related information (i.e., default channel table information) should be applied or not may be contained in automatic accompaniment data (i.e., sequence data of FIG. 2).

In addition, although the embodiment has been described in connection with a case where there is provided only one set of the common note-conversion-related information (default channel table), more than one set of such default information may be provided so that one of the pieces is selected optionally. For example, there may be provided plural sets of default channel table information as shown in FIG. 2B may be provided so that any one set of the information is selected by a suitable means and thus a default channel table corresponding to a performance part or channel number in event data is used.

The present invention arranged in the above-described manner achieves the benefit that it can effectively reduce the necessary memory capacity for storing the note-conversion-related information.

What is claimed is:

1. An automatic performance device comprising:

first storage means for storing a plurality of first automatic performance data and a plurality of second automatic performance data, and also for storing first information relative to note conversion specific to said first automatic performance data;

second storage means for storing second information relative to note conversion and common to said second automatic performance data;

readout means for, in accordance with progression of an automatic performance, reading out said first and second automatic performance data and also reading out first information in correspondence with the read-out first automatic performance data and second information in correspondence with the read-out second automatic performance data, and note conversion means for converting note data contained in said first automatic performance data on the basis of said first information and converting note data contained in said second automatic performance data on the basis of said second information.

2. An automatic performance device as defined in claim 1 wherein said note conversion means includes a plurality of note conversion tables, and said first and second information contains information to select one of the note conversion tables so that the note conversion processing of said first and second automatic performance data is performed with reference to the note conversion tables selected by said first and second information.

3. An automatic performance device as defined in claim 1 wherein said first and second information relative to note conversion contains source chord information having at least either of root information and type information indicative of a chord on which said first and second automatic performance data is based, and said note conversion means performs the note conversion processing on the basis of the source chord information.

4. An automatic performance device as defined in claim 1 wherein said first and second information relative to note conversion contains pitch range setting information for setting a pitch range of the automatic performance data having undergone the note conversion processing, and which further comprises means for, in accordance with the pitch range setting information, controlling a pitch range of the automatic performance data having undergone the note conversion processing.

5. An automatic performance device as defined in claim 1 wherein said first and second information relative to note conversion contains permission information for permitting tone generation based on the automatic performance data on condition that a performed chord has a predetermined root or type, and which further comprises designation means for designating a chord, and control means for, when the chord designated by said designation means has the predetermined root or type, permitting generation of an automatic performance sound based on said first or second automatic performance data corresponding to the designated chord in response to the permission information.

6. An automatic performance device as defined in claim 1 which further comprises designation means for designating a chord, and wherein said note conversion means performs the note conversion processing on the basis of the chord designated by said designation means and said first or second information.

7. An automatic performance device as defined in claim 1 wherein said note conversion processing performed by said note conversion means comprises converting a note, not converting a note and inhibiting generation of a note.

8. An automatic performance device comprising:

first storage means for storing a plurality of automatic performance data for a plurality of channels, said first storage means also storing first information relative to note conversion in corresponding relations to at least some individual channels from among the channels;

second storage means for storing second information relative to note conversion independently of said first information stored in said first storage means, and note conversion means for reading out the automatic performance data from said first storage means and note-converting the read-out automatic performance data on the basis of said first or second information, wherein said note conversion means note-converts the read-out automatic performance data on the basis of said first information for each of the channels for which said first information stored in said first storage means, while said note conversion means note-converts the read-out automatic performance data on the basis of said second information for each of the channels for which said first information is not stored in said first storage means, so as to generate automatic performance sounds based on note-converted data.

9. An automatic performance device as defined in claim 8 wherein said note conversion means includes a plurality of note conversion tables, and each of said first and second information contains information to select one of the note conversion tables so that the note conversion processing of said first and second automatic performance data with reference to the note conversion tables selected by said first and second information.

10. An automatic performance device as defined in claim 8 wherein said first and second information relative to note conversion contains source chord information having at least either of root information and type information indicative of a chord as a basis for said first and second automatic performance data, and said note conversion means performs the note conversion processing on the basis of the source chord information.

11. An automatic performance device as defined in claim 8 wherein said first and second information relative to note conversion contains pitch range setting information for setting a pitch range of the automatic performance data having undergone the note conversion processing, and which further comprises means for, in accordance with the pitch range setting information, controlling a pitch range of the automatic performance data having undergone the note conversion processing.

12. An automatic performance device as defined in claim 8 wherein said first and second information relative to note conversion contains permission information for permitting tone generation based on the automatic performance data on condition that a performed chord has a predetermined root or type, and which further comprises designation means for designating a chord, and control means for, when the chord designated by said designation means has the predetermined root or type, permitting generation of an automatic performance sound based on said first or second automatic performance data corresponding to the designated chord in response to the permission information.

13. An automatic performance device as defined in claim 8 wherein said note conversion processing performed by said note conversion means comprises converting a note, not converting a note and inhibiting generation of a note.

14. An automatic performance device comprising:

first storage means for storing a plurality of automatic performance data, said plurality of automatic performance data being classified into a plurality of attributes;

second storage means for storing first information relative to note conversion of the automatic performance data, said first information corresponding to specific attributes;

third storage means for storing second information relative to note conversion of the automatic performance and common to attributes other than said specific attributes;

readout means for reading out the automatic performance data from said first storage means in accordance with progression of an automatic performance, during which time said readout means, in correspondence with readout of first of said automatic performance data classified into one of the specific attributes, reads out from said second storage means said first information corresponding to the attribute of said first automatic performance data and also, in correspondence with readout of second said automatic performance data classified into one of the other attributes, reads out said second information from said third storage means, and note conversion means for performing note conversion processing of note data contained in said first automatic performance data on the basis of said first information and performing note conversion processing of note data contained in said second automatic performance data on the basis of said second information, so as to generate note-converted automatic performance sounds.

15. An automatic performance device as defined in claim 14 wherein said first storage means stores attribute information along with the automatic performance data, and wherein said readout means reads out the automatic performance data and attribute information from said first storage means and reads out said first information from said storage means or said second information from said third storage means depending on the read-out attribute information.

16. An automatic performance device as defined in claim 15 wherein when said first information corresponding to the read-out attribute information is not stored in said second storage means, said readout means reads out said second information from said third storage means.

17. An automatic performance device as defined in claim 14 wherein the automatic performance data stored in said first storage means is automatic accompaniment data, and said attributes are defined according to at least one of accompaniment style, accompaniment pattern section and accompaniment sound generation channel.

18. An automatic performance device comprising:

first storage means for storing a plurality of first automatic accompaniment data along with first information relative to note conversion;

second storage means for storing a plurality of second automatic accompaniment data;

third storage means for storing second information relative to note conversion common to said plurality of second automatic accompaniment data, and accompaniment means for executing a predetermined accompaniment by reading out said first automatic accompaniment data and first information to note-convert said first automatic performance data on the basis of said first information, and also executing a predetermined accompaniment by reading out said second automatic accompaniment data and second information to note-convert said second automatic performance data on the basis of said second information.

* * * * *